United States Patent [19]

Furyk et al.

[11] 4,123,058

[45] Oct. 31, 1978

[54] GAME: DISK-GOLF

[75] Inventors: Robert C. Furyk; Jon E. P. Gow, both of Barrie, Canada

[73] Assignee: Creative Inventions

[21] Appl. No.: 798,776

[22] Filed: May 20, 1977

[51] Int. Cl.[2] ..... A63F 7/06

[52] U.S. Cl. ..... 273/87 H; 108/139; 273/128 R; 273/280

[58] Field of Search ..... 273/87, 87.2, 87.4, 273/176 B, 176 H, 176 G, 176 E, 128 R, 280; 108/139, 103, 94

[56] References Cited

U.S. PATENT DOCUMENTS

| | | | |
|---|---|---|---|
| 321,977 | 7/1885 | Kamerer | 108/94 |
| 1,591,095 | 7/1926 | Meyer | 273/87 C X |
| 1,606,911 | 11/1926 | Winbigler | 273/87.2 |
| 1,732,518 | 10/1929 | Jurs | 273/87.2 |
| 1,864,500 | 6/1932 | Livingston et al. | 273/87 H X |
| 1,980,637 | 11/1934 | Savory | 273/280 |
| 2,794,646 | 6/1957 | Knott | 273/176 H UX |
| 3,343,901 | 9/1967 | Marcus | 108/139 X |
| 3,809,404 | 5/1974 | Fikse | 273/176 H X |
| 3,862,760 | 1/1975 | Davis | 273/176 E |

FOREIGN PATENT DOCUMENTS

| | | | |
|---|---|---|---|
| 254,008 | 5/1967 | Austria | 273/176 H |
| 842,650 | 5/1970 | Canada | 273/87 H |
| 13,202 | 5/1910 | Denmark | 108/139 |
| 588,096 | 11/1933 | Fed. Rep. of Germany | 108/139 |
| 21,778 of | 1898 | United Kingdom | 273/87 H |
| 176,164 | 3/1922 | United Kingdom | 273/128 R |
| 263,232 | 12/1926 | United Kingdom | 273/87 H |
| 385,144 | 12/1932 | United Kingdom | 108/139 |

*Primary Examiner*—Paul E. Shapiro

[57] ABSTRACT

A horizontal circular disc is disposed upon and is manually rotatable about the center of a square shaped horizontal top. A depressed central circular area of the disc simulates the green of a hole of a golf course and has an offset depression simulating the cup. The outer annular area is divided into a plurality of sectors of like area by radial lines. Each sector has a differently contoured top surface with roughened and smooth sections simulating the arrangement of different holes other than the green. Flat like horizontal ring shaped members (raceways) each have a plurality of spaced balls (ball bearings) therein, each ball being individually rotatable therein and having a bottom portion which extends below the member and engages the top surface of the disc when the member is place therein. Each member is dimensioned to fit into the depression and simulates a golf ball. A start position is marked on the table top. Each player in turn strikes his member with his finger to move his "ball" along the course.

8 Claims, 5 Drawing Figures

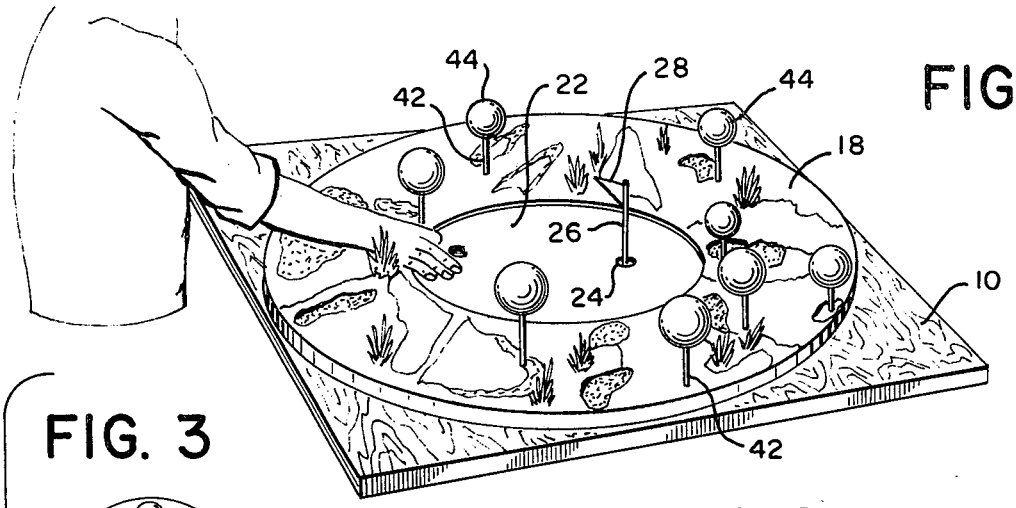
FIG. 1
FIG. 3
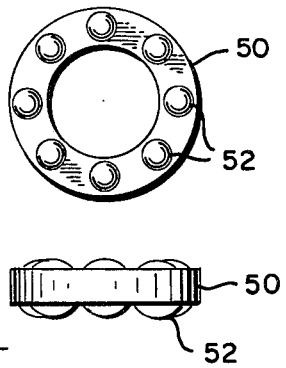
FIG. 2
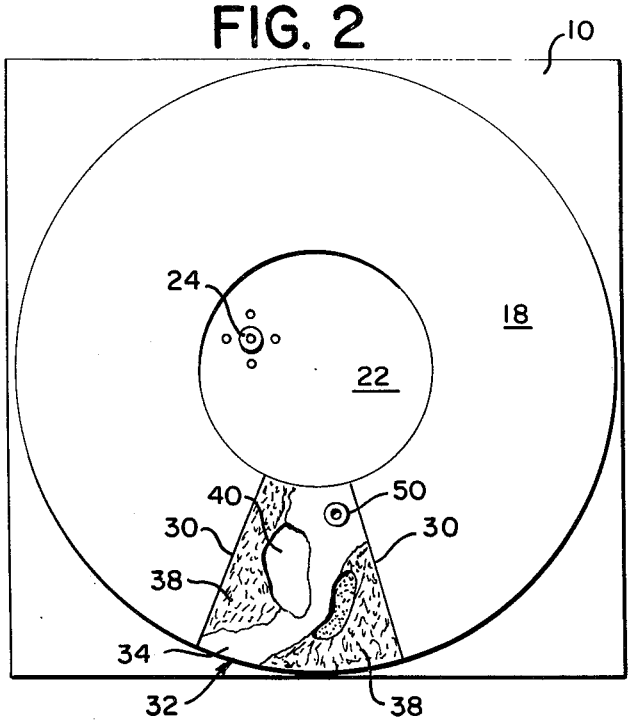
FIG. 4
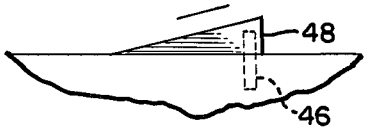
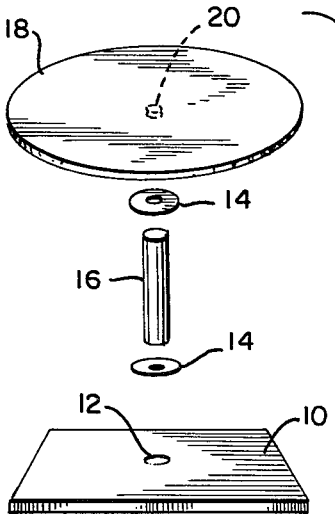
FIG. 5

GAME: DISK-GOLF

PRIOR ART STATEMENT

U.S. Pat. Nos. 2,207,638; 3,844,558; 3,871,650; 3,912,270; and 3,989,249 show various types of table top games simulating golf and using individual balls as movable members. U.S. Pat. No. 3,638,944 shows a movable spot of light simulating movement of a golf ball. None of these patents shows a simulated course as taught herein and none of these patents shows circular raceways with ball bearings used to simulate golf balls.

SUMMARY OF THE INVENTION

This invention is directed toward a new type of table top game for simulating golf which can be played by two or more players. The game enables the players to play a simulated golf course of any number of simulated holes, using movable members guided by being struck by fingers of the players. These members are designed to be moved much more accurately than individual small balls previously employed whereby the game becomes much more precise and challenging. The simulated course, if so desired, can be an accurate representation of any selected actual golf course and can be changed other simulated courses as desired.

To this end, a game employed the principles of the invention utilizes a flat horizontal base and a horizontal plate having a circular periphery. Means detachably secure the plate on top of the base in a manner at which the plate can be rotated manually about its center while the base remains stationary.

The top surface of the plate has an inner recessed circular area with an off center small depression therein and an outer area which is annular in shape.

The inner area can have a smooth but somewhat irregular surface and can be painted green, simulating the green of any hole. The depression simulates the cup.

The outer area is divided by radial lines into a plurality of sectors of like area. Each sector together with the simulated green simulates a hole. Each sector has a top surface with roughened sections simulating the rough of a hole and smooth sections simulating the fairway. The smooth sections communicate beteen the outer and inner periphery of the annular outer area. One or more sections can contain recesses filled to levels above their top surfaces with sand particles secured in position to simulate sand traps and other recesses simulating water hazards.

Each player is given a horizontal ring shaped member having a plurality of spaced balls therein. Each ball is individually rotatable and has a portion extending below the member and engaging the top surface of the plate when the member is placed thereon. The members are used to simulate golf balls and are all alike, being so dimensioned as to fit into the cup simulating depression.

Each sector is numbered. A start position is located on the base so as to be visible to the player. The plate is rotated so that the first sector is located at the start position and each player strikes his member in turn, the game being played in accordance with the rules of golf. Then the plate is rotated to position the second sector at the start position and this process continues until the game is finished.

Since the plate is removable it can be replaced after use with another plate so that any number of different simulated holes can be played as desired. The game can be equipped with a plurality of different plates, each plate identifying a different well known course, to provide greater challenge for the players.

BRIEF DESCRIPTION OF THE DRAWINGS

FIG. 1 is a perspective view of the invention in use.

FIG. 2 is a top view thereof.

FIG. 3 shows top and side views of the ring shaped member.

FIG. 4 shows several parts in side view which can be used with the plate of FIGS. 1 and 2.

FIG. 5 is an exploded view of some of the parts used in the invention.

DETAILED DESCRIPTION OF PREFERRED EMBODIMENTS

Referring now to FIGS. 1–5, a square shaped flat horizontal base 10 typically about 4 feet on a side and about 2 inches thick is placed removably on a table top or other support. A vertical bore 12 typically about ½ inch in diameter is formed in the base at its center and extends downward from the top either partially or completely through the base. A first teflon disc 14 typically about 8 inches in diameter and about ¼ inch thick is glued to the top of the ase with a ½ inch central hole therein in registration with the hole in the base.

A vertical shaft 16 is secured into the bore 12 and extends upward through the hole is disc 14. The shaft is glued or otherwise held in place.

A circular plate 18 typically 4 feet in diameter and about 1½ inches thick has a central bore 20 about ½ inch in diameter extending upwards about ½ inch from the bottom surface. A second like disc 14 is secured to this bottom surface with its central hole aligned with bore 20 and bore 12, both discs 14 being in very low friction contact. Shaft 16 extends into bore 20 so that plate 18 is manually rotatable thereabout and can be lifted off the shaft and replaced as desired.

A circular central recess 22 typically about 2 feet in diameter and about ¼ inch thick is cut into plate 18. This recess is colored green to resemble the green of a hole and the top surface is textured to provide sloping rolling areas while remaining smooth. Recess 22 contains an offset depression 24 typically 1¼ inches in diameter. The recess can have a small bore at the bottom and can have additional bores around the periphery whereby the post 26 of simulated flag 28 can be placed in any of these bores removably as desired.

The plate 18 has an outer annular surface with an inner diameter typically of 2 feet and an outer diameter equal to that of the plate. Radial lines 30 divide the outer surface into a plurality of sectors 32 of like area. Typically there can be nine sectors for a simulated 9 hole course or 18 sectors for a simulated 18 hole course.

Each sector has a smooth section 43 on its top surface extending between the outer and inner periphery of the annular surface which simulates the fairway. Although the same green together with each of the sectors defines each of the simulated holes, the offset position of the depression 24 enables each hole to have a differently disposed fairway with a different approach to the cup. If desired, an irregularly or regularly shaped recess 36 can be disposed in any sector and overfilled with a mixture of said glue and to have a rough and uneven surface. Each sector has one or more sections 38 or rough textured top surface which simulate the rough. If desired recesses 40 can be cut into the top surface of any sector as desired and painted blue to simulate a water hazard.

The rough sections can have bores into which a trunk 42 of a simulated tree 44 can be disposed as desired.

In order for the players to use their simulated golf balls to clear hazards, the simulated fairways can have small bores into which the pin 46 of ramp 48 can be disposed in such manner that the ramp can be rotated in the bore to swivel.

Each simulated ball takes the form of a horizontal ring shaped member 50 typically having an outer diameter of about one and one quarter inches and an inner diameter of about three quarters of an inch. It can be the inner raceway of a thrust bearing. It can contain typically eight ball bearings 52 equidistantly spaced and individually rotatable. Each bearing typically can be five eighths of an inch in diameter. The member can be typically one quarter inch thick so that a portion of each ball extends a like amount above and below the top and bottom surfaces of the member.

A start position can be marked on one disposed corner of the base and the game can be played as previously described.

It will be apparent to those skilled in the art that a wide variety of woods, metal plastics or other materials can be used to construct the various components described herein and that the dimensions can be varied as desired.

It will also be apparent that although the specific embodiment has been described with specific reference to the drawings, many variations within the scope and sphere of the invention can be had and the protection obtained herein is to be limited only by the claims which follow.

We claim:

1. A game for simulating golf comprising:

a flat horizontal base;

a horizontal plate having a circular periphery, the top surface of said plate having an inner circular area which is recessed below the top surface and has an off-center small depression therein and an outer area which is annular in shape, said outer area being divided by radial lines into a plurality of sectors of like area, each sector having a top surface with roughened and smooth sections, said smooth sections communicating between the outer periphery and the inner periphery of said outer area; each sector having a different configuration of its top surface; and means detachably securing said plate on top of said base in a manner at which said plate can be manually rotated about its center in either of clockwise and counterclockwise directions, while the base remains stationary, said means including a vertical shaft disposed at its bottom end in said base, the top end of the shaft being disposed in the center of the plate.

2. The game of claim 1 wherein said means includes first and second flat horizontal like Teflon discs, smaller in diameter than that of the plate, one disc being secured to the bottom surface of the plate, the other disc being secured to the top surface of the base, said discs being in low friction contact, said shaft passing through the centers of both discs.

3. The game of claim 2 further including at least one horizontal ring-shaped member carrying a plurality of spaced like balls therein disposed about a central opening, each ball being individually rotatable, each of said balls having a portion extending below the member to the same like amount and engaging the top surface of said plate when said member is placed thereon, said member being dimensioned to fit into said depression.

4. The game of claim 1 wherein at least one of the sectors has a second depression in one of its sections.

5. The game of claim 4 wherein said depression contains said particles secured in position and defines a sandtrap.

6. The game of claim 3 wherein said depression defines a water hazard.

7. The game of claim 1 wherein at least one of the sectors has second and third spaced depressions in at least one of its sections.

8. The game of claim 1 wherein said roughened sections have spaced perforations for receiving the simulated tree trunks of simulated trees.

* * * * *